US007383767B2

(12) United States Patent
Aho

(10) Patent No.: US 7,383,767 B2
(45) Date of Patent: Jun. 10, 2008

(54) COUPLING CONSTRUCTION AND METHOD FOR JOINING AND LOCKING THE ROLLS OF EXTENDED-NIP PRESS

(75) Inventor: Erkki Aho, Elimäki (FI)

(73) Assignee: Vaahto Oy, Hollola (FI)

( * ) Notice: Subject to any disclaimer, the term of this patent is extended or adjusted under 35 U.S.C. 154(b) by 756 days.

(21) Appl. No.: 10/480,277

(22) PCT Filed: Jul. 5, 2002

(86) PCT No.: PCT/FI02/00613

§ 371 (c)(1),
(2), (4) Date: Dec. 11, 2003

(87) PCT Pub. No.: WO03/004888

PCT Pub. Date: Jan. 16, 2003

(65) Prior Publication Data

US 2004/0168585 A1 Sep. 2, 2004

(30) Foreign Application Priority Data

Jul. 5, 2001 (FI) ..... 20011473

(51) Int. Cl.
*B30B 3/04* (2006.01)
*D21F 3/00* (2006.01)

(52) U.S. Cl. ..... 100/153; 100/168; 72/237; 162/272; 162/358.3

(58) Field of Classification Search ..... 100/153, 100/168, 169, 170, 176; 72/237, 245, 248; 162/272, 273, 274, 358.3, 358.1; 68/244, 68/256, 272, 274; 425/194
See application file for complete search history.

(56) References Cited

U.S. PATENT DOCUMENTS 5,250,154 A * 10/1993 Didier ..... 162/273
5,507,223 A * 4/1996 Vallius ..... 100/153
5,547,547 A 8/1996 Bengtsson

FOREIGN PATENT DOCUMENTS

FI 97484 B 9/1996

* cited by examiner

*Primary Examiner*—Jimmy T. Nguyen
(74) *Attorney, Agent, or Firm*—Birch, Stewart, Kolasch & Birch, LLP

(57) ABSTRACT

A yoke assembly for connecting and securing to each other rolls forming a nip in an extended nip press, whereby at least one of the rolls of the extended-nip press includes loading means for loading the endless-loop blanket of one roll against the other one of the extended-nip press rolls so as to establish the nip. The rolls are dismountably connected to each other and the yoke assembly includes rotatable connecting members for detachably connecting the rolls to each other by their bearing blocks. The connecting member includes a first clamping surface adapted slidably rotatable on the respective mating surface of a first roll bearing block so that the first clamping surface and the respective mating surface of the first roll bearing block to be connected therewith form a pivotal joint about which the connecting member can be rotatably disengaged from the mating surface of a second roll bearing.

17 Claims, 3 Drawing Sheets

COUPLING CONSTRUCTION AND METHOD FOR JOINING AND LOCKING THE ROLLS OF EXTENDED-NIP PRESS

CROSS-REFERENCE TO RELATED APPLICATION

The present application claims priority under 35 U.S.C. §119 to Finnish Patent Application No. 20011473, filed Jul. 5, 2001, the entire contents of which are hereby incorporated by reference.

BACKGROUND OF THE INVENTION

1. Field of the Invention

The present invention relates to a yoke assembly and a method in accordance with the preambles of appended base claims for connecting and securing the rolls of an extended-nip press to each other.

2. Description of Background Art

Generally the press zone, or nip, in an extended-nip press is formed by two substantially parallel to each other aligned rolls that in the present case are a shoe roll and a backing roll. The shoe roll comprises a rotating endless-loop blanket of a flexible, liquid-impervious material, a rigid roll support beam mounted in a stationary fashion so as to extend axially through the interior of the endless blanket, at least one loading shoe supported by the support beam and having a concave top face, and loading means for pressing the concave top face of the loading shoe against the flexible endless blanket so that the endless blanket forms a press nip zone in cooperation with the backing roll. Both the shoe roll and the backing roll are rotatably mounted by their both ends in bearing blocks.

An extended-nip press is characterized by a high line load in the nip. At its maximum, the line load may be as high as 2000 kN/m. Hence, a conventional screw-loaded connection between the rolls is not generally practicable. Therefore, it is known in the art to adapt the bearing blocks of one roll in a close vicinity of the bearing blocks of the opposed roll so that the rolls may be connected and secured to each other by means of connecting members linking the bearing blocks to each other.

E.g., patent publication FI 101633 discloses a yoke assembly and method for connecting the rolls of an extended-nip press to each other. In the arrangement of cited patent publication, the bearing blocks of the extended-nip press rolls are joined to each other by connecting members. The connecting member described in the publication is adapted to rotate relative to the bearing block so that the end of the connecting member is locked in a wedged fashion to the other bearing block. The displacement, or outdistancing, of the connecting member from the bearing block, whereto the connecting member is joined, is effected by means of a hydraulic cylinder. In the construction according to cited publication, both roll ends are provided with two connecting members that are lockable to either side of the bearing block relative to the cross-machine center axis of the press rolls.

Both ends of the connecting member are provided with a pivot point allowing the connecting member to rotate pivotally in either one of the bearing blocks, whereby it is possible to select the upper or, alternatively, the lower bearing block to act as the pivot point. This construction suffers from several shortcomings including a need for wide elbowroom and incompatibility with the renovation requirements of existing machines.

Also patent publication U.S. Pat. No. 5,547,547 discloses an interconnection assembly for the rolls of an extended-nip press based on connecting members that are clampable to the bearing blocks. The roll interconnection arrangement described in cited publication comprises U-shaped connecting members that engage with the mating surfaces of the bearing blocks of the rolls. Additionally, each one of the connecting members is provided with pivot points about which the connecting member can be rotated to disengage from and engage with a mating surface provided on the bearing block. As described in cited publication, at both ends of the connecting members of the assembly is also adapted a hydraulic actuator having the end portions of the connecting members connected to its ends, whereby the hydraulic actuator facilitates the rotation of the connecting members about their pivot points. Inasmuch the arrangement of cited publication employs separate pivot points for implementing the rotation of the connecting members, the construction suffers from the need for wide elbowroom when the assembly is being disengaged. Furthermore, this embodiment is very critical as to its manufacturing tolerances in regard to trouble-free operation. Moreover, the roll nip must be initially driven quite wide to allow unrestricted opening of the press.

SUMMARY AND OBJECTS OF THE INVENTION

It is an object of a press roll according to the present invention to eliminate or at least reduce the problems related to the prior art described above. To accomplish this goal and others, a roll connecting yoke assembly and method according to the invention are principally characterized by what is stated in the characterizing part of appended base claims.

A roll connecting yoke assembly according to the present invention is characterized in that the connecting member comprises a first clamping surface adapted slidably rotatable on the respective mating surface of a first roll bearing block so that the first clamping surface and its respective mating surface of a first roll bearing block to be connected therewith form a pivotal joint about which the connecting member can be rotatably disengaged from the mating surface of a second roll bearing block and, respectively, engaged with the mating surface of the second roll bearing block. Herein it must be noted that a pivotal joint formed by the first clamping surface and its mating surface must be understood to refer generally to such a structure that facilitates the rotation of the connecting member in regard to a bearing block so as to keep the connecting member during its rotation substantially continuously in contact with the bearing block, whereby the clamping surface of the connecting member and the respective mating surface of the bearing block act in the same fashion as a pivotal joint. In the present context, rotation of the connecting member refers to an automatically or manually actuated operation during which the position of the connecting member relative to the bearing block changes.

Accordingly, the connecting member according to the present invention facilitates the rotation of the connecting member without the need for a separate pivotal joint, thus making the present roll connecting yoke assembly simple and highly functional. Moreover, the elbowroom required for disengaging the connecting member is substantially reduced in regard to prior arrangements.

In a preferred yoke construction according to the invention, the connecting member comprises a body part formed by a first end portion having the above-mentioned first clamping surface, a second end portion having a second clamping surface thereon and a middle portion situated between the first and the second end portion. By virtue of the first clamping surface, the connecting member can be engaged with the respective mating surface of the first bearing block, while the second clamping surface performs the same engagement with the respective mating surface of the second bearing block. The middle portion between the first and the second end portion of the connecting member allows the mating surface of the first bearing block and the mating surface of the second bearing block to be displaced at a suitable distance from each other.

In a particularly advantageous embodiment of the yoke assembly according to the invention, the first clamping surface has an essentially cylindrically curved contour. Preferredly, the second clamping surface has a curved, advantageously concave contour. Herein, an essentially cylindrically contoured clamping surface must be understood to refer to an at least partially outwardly curved or convex surface that may also include planar portions or be itself a portion of a substantially planar surface. Such a cylindrically contoured clamping surface facilitates the rotation of the connecting member on the mating surface of the bearing block that respectively is advantageously made substantially concave such that allows the mating pair of surfaces to perform in the same fashion as a pivotal joint. Herein, the curvature of the first mating surface facilitates the rotation of the connecting member and, resultingly, rotation to the second mating surface against the other one of the mating surfaces, advantageously having a convex curvature, so as to connect and lock the bearing blocks to each other.

In an advantageous embodiment of the yoke assembly according to the present invention, the connecting members adapted to connect the bearing blocks of the roll heads to each other are linked to each other and connected to one of the bearing blocks at the end portions of the first clamping surfaces, advantageously via a link plate, whereby the connecting members thus linked to each other are pivotally rotatable about pivot points by means of a pneumatic actuator adapted to cooperate therewith.

A pressurized-medium-driven actuator such as a pneumatic or hydraulic cylinder connected to the connecting members permits automatic rotation of the connecting members thus facilitating fast and easy engagement and disengagement of the roll yoke assembly. Furthermore, no separate pivotal joints or pivot points are required inasmuch the connecting members are linked with the bearing blocks by the end portions of the clamping surfaces acting in the same fashion as a pivot point, whereby a compact construction results needing minimal elbowroom.

The use of a link plate for joining the connecting members with the bearing block improves the strength and functionality of the construction, since the bearing block need not be provided with separate link fixtures on the end portions of the clamping surfaces. Moreover, the link plate prevents the connecting member from becoming detached from the bearing block when the yoke assembly is in its disengaged position. It must be noted that in this context the term "end portion of the clamping surface" is used when reference is made to the clamping edge portion of the connecting member and its distal portion at the clamping surface.

In a particularly advantageous embodiment of the yoke assembly according to the present invention, the connecting members are adapted lockable in regard to each other by locking means adapted to operate between the connecting members joining the bearing blocks with each other. The function of the locking means is to secure that the connecting members during a possible malfunction situation cannot recede from each other thus failing to clamp the bearing blocks. In this context, the term "locking means" is used when reference is made to a structure comprising one or more elements capable of preventing unintentional rotation of the connecting members. This kind of locking means may comprise, e.g., locking eyelets with a bolt hole adapted at the sides of the connecting members, whereby a locking bolt tightenably insertable through the eyelets so as to lock the connecting members to each other.

Advantageously, the connecting members of the yoke assembly according to the invention joining two bearing blocks that are at least partially situated above one another are located to both sides of the machine-direction center axis of the bearing blocks in such a fashion that one of the connecting members is on one side of the center axis while the other one is on the opposite side of the center axis. In this context, the term "machine-direction center axis of bearing blocks" is used when reference is made to a virtual axis that is aligned perpendicular to the cross-machine center axis of the bearing block, thus being substantially parallel to the machine direction of the paper or paperboard machine.

The method according to the present invention is principally characterized in that the connecting member is moved between its disengaging and engaging positions by way of rotating the connecting member so as to slidably rotate a first clamping surface of the connecting member on a mating surface provided on the bearing block to be clamped by means of the connecting member.

One of greatest benefits of the roll connecting yoke assembly and method according to the present invention is the structurally and functionally simple arrangement used in the invention. The construction according to the invention offers safe and reliable locking. Furthermore, the elbowroom requirements in the disengagement and engagement of the yoke assembly are minimal. Still further, the construction according to the invention is cost-effective to manufacture.

BRIEF DESCRIPTION OF THE DRAWINGS

In the following, the invention is described in more detail by making reference to the appended drawings in which.

DETAILED DESCRIPTION OF THE PREFERRED EMBODIMENTS

Figure 1:
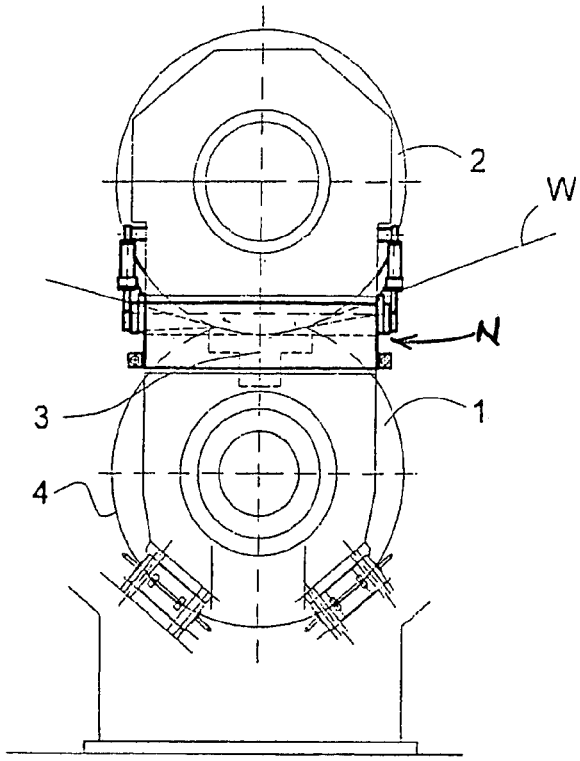
FIG. 1 is a diagrammatic elevational side view of an extended-nip press.

In FIG. 1 is diagrammatically shown an exemplary embodiment of the construction of an extended-nip press used in a papermaking machine, wherein a web W is passed into a nip N between a lower shoe roll 1 and a backing roll 2 placed thereabove. The backing roll may be a heated roll or a nonheated roll. The shoe roll 1 includes loading means 3 and an endless-loop blanket 4. Loading means 3 comprise at least a loading shoe and actuators for loading the endless blanket by means of the press shoe against the backing roll so as to form the above-mentioned nip N and to remove water from the web W passed into the nip. In this context, the web W is a paper or paperboard web. The extended-nip press also includes other parts and elements omitted from the diagram for greater clarity. These kinds of accessories are, e.g., lift machinery for elevating the upper roll, means for feeding coolant and lubricant to the sliding face of the shoe, etc. Further, an extended-nip press may be implemented in an inverted fashion whereby the shoe roll is located above the backing roll.

Figure 2:
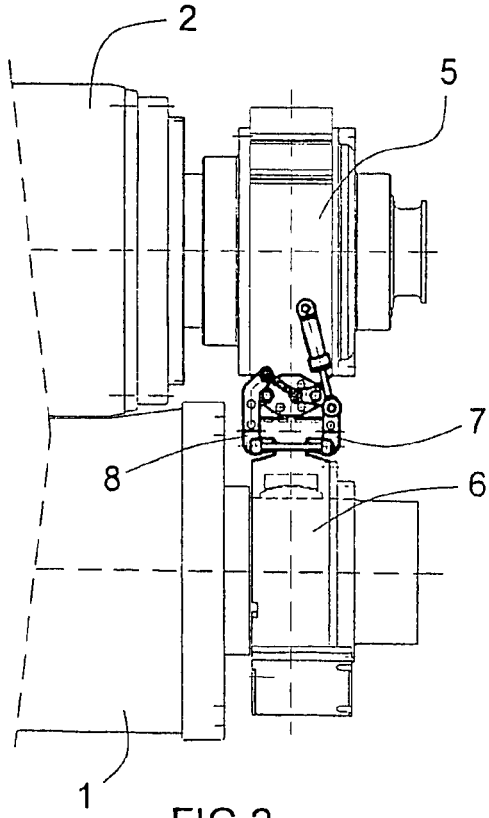
FIG. 2 is a diagrammatic view of an embodiment of a roll connecting yoke assembly according to the invention with its disengagement mechanism as seen in the machine direction.

FIG. 2 shows one end of rolls 1 and 2 of FIG. 1 as seen in the machine direction. As illustrated in the diagram, the rolls are connected to each other by the yoke assembly according to the present invention. In the yoke assembly, a first bearing block 5 (upper bearing block in the diagram) and a second bearing block 6 (lower bearing block in the diagram) are connected to each other by connecting members 7 and 8, thus establishing a connection between the upper roll and the lower roll of the press. The bearing blocks at either end of the rolls are connected to each other by similar connecting members.

Figure 3:
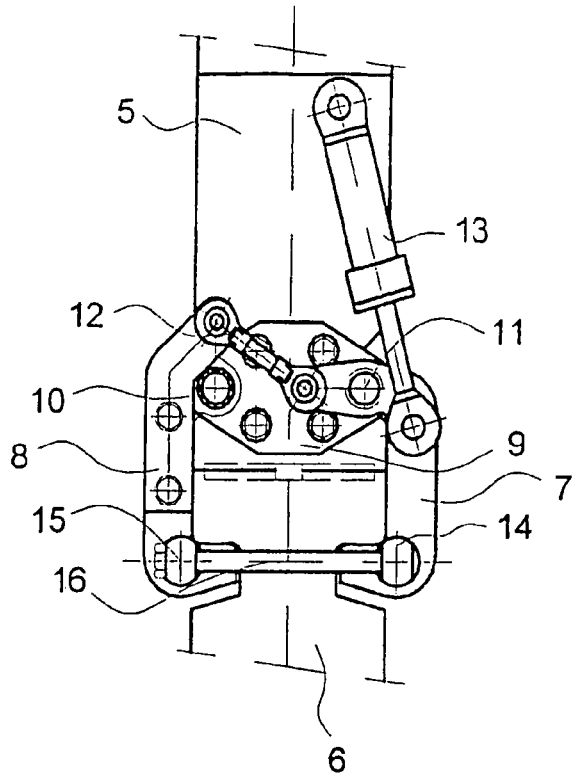
FIG. 3 is an enlarged diagrammatic view of the yoke assembly of FIG. 2.

FIG. 3 shows an enlarged view of the yoke assembly of FIG. 2. As shown in the diagram, the yoke assembly comprises connecting members 7 and 8 that are coupled to the first bearing block via a link plate 9 attached by screws to the bearing block 5 (while not shown, the opposite side of the bearing block is equipped with a similar link plate). The connecting members 7 and 8 are coupled to the link plate 9 at connecting member pivot points 10 and 11. Advantageously, a bearing is adapted between the pivot point and the link plate. The connecting members 7 and 8 are coupled to each other by means of a link lever 12 having pivotal joints adapted to its both ends. Between connecting member 7 and bearing block 5 is further adapted to operate a pressurized-medium-driven actuator 13 by means of which connecting member 7 can be rotated about pivot point 11. Link lever 12 transmits the rotary movement of connecting member 7 to connecting member 8 thus facilitating the use of a single pneumatic/hydraulic actuator for simultaneous rotation of both connecting members 7 and 8.

In FIG. 3 is also shown the locking arrangement of connecting members 7 and 8 to each other with the help of a locking means that is adapted between the connecting members and comprises eyelet pegs 14 and 15 projecting from the plane of the connecting members and being secured to each other by a detachable locking bolt 16 spanned therebetween. In this fashion, the locking bolt joining the locking pegs prevents inadvertent disengagement of the connecting members.

Figure 4:
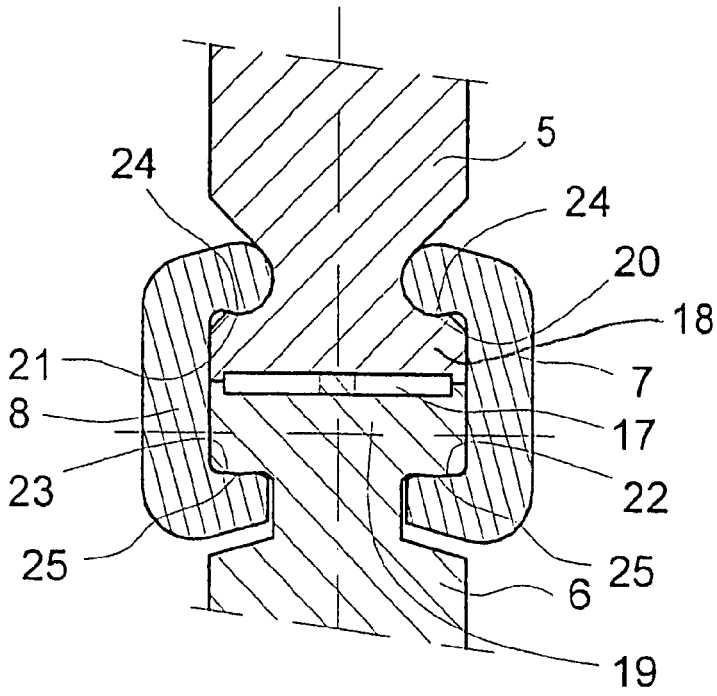
FIG. 4 is a diagrammatic cross-sectional view of a portion of the yoke assembly according to the invention.

FIG. 4 shows a cross-sectional view of a yoke assembly according to the invention. In the diagram is shown a first bearing block 5 and a second bearing block 6 with connecting members 7 and 8 that are adapted on opposite sides of the bearing blocks and connect them to each other. Between bearing blocks 5 and 6 is placed a wedge 17 that aligns the bearing blocks in a correct position relative to each other by way of fitting into recesses made on the opposedly mating surfaces of the bearing blocks.

The lower end 18 of the first bearing block 5 has an essentially inverted-T-shaped cross section in order to provide mating surfaces 20 and 21 compatible with the shape of the connecting member upper portions. Respectively, the upper end 19 of the second bearing block 6 has an essentially T-shaped cross section to provide mating surfaces 22 and 23 for the clamping surfaces of the connecting member lower portions.

Connecting members 7 and 8 comprise a body part having a first end portion having a first clamping surface 24 made thereon and a second end portion having a second clamping surface 25 made thereon, and a middle portion connecting these end portions. The clamping surfaces of the connecting member are adapted to fit against mating surfaces provided on the bearing blocks. The middle portion of the connecting members allows the clamping surfaces to be outdistanced rather apart from each other, whereby also the mating surfaces of the bearing blocks can be outdistanced sufficiently from the outer edge of the bearing to achieve a rigid construction.

As shown in FIG. 4, the upper mating surfaces 20 and 21 of the first bearing block 5 are made substantially concave. Respectively, the first clamping surfaces of connecting members 7 and 8 that rest on the first mating surfaces 20 and 21 are made cylindrically convex. In this fashion, the first mating surface of the bearing block and the first clamping surface of the connecting member form a pivotal joint (that is, pivot points 10 and 11 shown in FIG. 3) facilitating the rotation of the connecting member about the joint formed by the first clamping surface of connecting member in cooperation with the compatible mating surface of the bearing block.

The mating surfaces 22 and 23 of the second bearing block 6 are made substantially convex. Respectively, the second clamping surface 25 of the connecting member engaging with the mating surface of the second bearing block is made substantially curved in a compatible fashion. Hence the shapes of the mating surfaces of the second bearing block in cooperation with the second clamping surface of the connecting member facilitate rotation of the connecting member into the position shown in FIG. 4, that is, into the engaged position and, respectively from this position into the disengaged position.

Figure 5A:
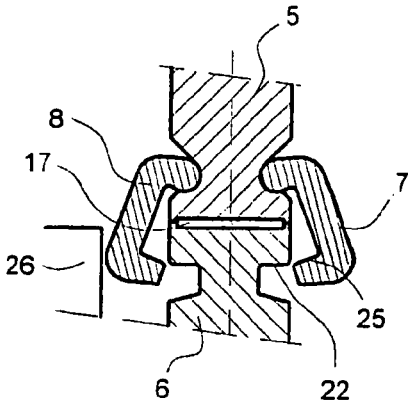
FIGS. 5*a*-5*c* illustrate diagrammatically the disengagement steps of the yoke assembly connecting members.
Figure 5B:
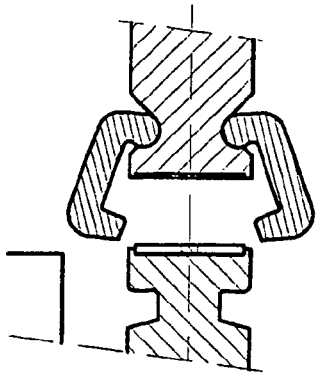
Figure 5C:
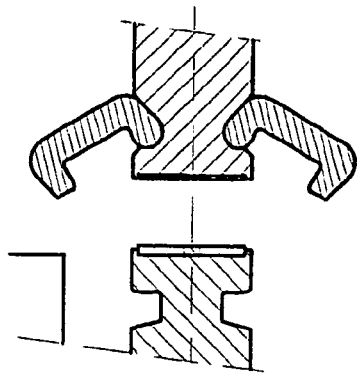

FIGS. 5*a*-5*c* show diagrammatically the disengagement steps of the yoke assembly according to the invention. The elements shown in FIGS. 5*a*-5*c* are the first bearing block 5, the second bearing block 6, connecting members 7 and 8, the wedge 17 placed between the bearing blocks and a portion of the end 26 of the lower roll 1.

In the first step of disengagement shown in FIG. 5*a*, the upper roll lift machinery has been operated to lower the rolls against each other, whereby also the superposed bearing blocks are in contact with each other. Hereby, between the second clamping surface 25 of the connecting member and the mating surface 22 of the second bearing block 6 is formed a gap facilitating the rotation of the connecting member. Next, the connecting members are rotated about the joint formed between the mating surface of the first bearing block and the first clamping surface of the connecting member so as to disengage the second clamping surface 25 from the mating surface 22 of the second bearing block, whereby the first bearing block with the connecting members coupled thereto can be lifted upward as shown in FIG. 5*b*. The upper roll and therewith the first bearing block are elevated at least so high as to permit the connecting members to rotate into a fully disengaged position. Subsequently, the rolls of the extended-nip press can be serviced, whereby the endless blanket of the lower roll may be replaced, for instance. The rolls are connected to each other in a reverse order. Herein, the connecting members assume their engaged position when the shoe roll is loaded against the backing roll causing the rolls to recede from each other, whereby the bearing blocks tend to move apart from each other thus causing the clamping surfaces of the connecting members to assume their engaged position against the mating surfaces of the bearing blocks.

It must be borne in mind that the invention is by no way limited to the exemplary embodiment described above, but rather may be modified as required without departing from the scope and inventive spirit of the appended claims.

What is claimed is:

1. A yoke assembly for connecting and securing an upper roll and a lower roll together, the upper and lower rolls forming a nip in an extended-nip press, whereby at least one of the rolls of the extended-nip press includes loading means for loading an endless-loop blanket of one of the rolls against the other of the rolls of the extended-nip press so as to establish the nip, wherein the lower roll and the upper roll are dismountably connected to each other and the yoke assembly connecting the upper and lower rolls of the extended-nip press to each other includes rotatable connecting members by means of which the extended-nip press rolls are detachably connected to each other by a pair of bearing blocks, wherein each of the connecting members comprises a first clamping surface adapted to be slidably rotatable on a respective mating surface of a first roll bearing block so that each of said first clamping surfaces and said respective mating surface of said first roll bearing block to be connected therewith form a pivotal joint about which the respective connecting member is adapted to be rotatably disengaged and engaged from a respective mating surface of a second roll bearing block, wherein the connecting members are adapted to connect the bearing blocks of roll heads of the upper and lower rolls to each other and the connecting members are linked to each other and are connected to one of the bearing blocks at an end portion of the first clamping surface via a link plate, whereby the connecting members thus linked to each other are pivotally rotatable about the pivot points by a pressurized-medium-driven actuator adapted to cooperate therewith, wherein the mating surfaces of the first roll bearing block have shapes that are different from shapes of the mating surfaces of the second roll bearing block.

2. The yoke assembly of claim 1, wherein each of the connecting members comprises a body part formed by a first end portion having said first clamping surface, a second end portion having a second clamping surface thereon and a middle portion situated between the first and the second end portion.

3. The yoke assembly of claim 2, wherein the first clamping surface has an essentially cylindrically curved contour.

4. The yoke assembly of claim 2, wherein the second clamping surface has an essentially curved contour.

5. The yoke assembly of claim 1, wherein each of the mating surfaces of the first roll bearing block has an essentially concave contour.

6. The yoke assembly of claim 1, wherein each of the mating surfaces of the second roll bearing block has an essentially convex contour.

7. The yoke assembly of claim 1, wherein the pressurized-medium-driven actuator is a pneumatic or hydraulic cylinder adapted to rotate at least one of the connecting members.

8. The yoke assembly of claim 1, wherein the connecting members are adapted to be lockable in regard to each other by locking means adapted to operate between the connecting members joining the first and second roll bearing blocks with each other.

9. The yoke assembly of claim 1, wherein the connecting members joining the first and second roll bearing blocks are located to both sides of a machine-direction center axis of the first and second roll bearing blocks so that one of the connecting members is on one side of said center axis while the other one is on the opposite side of said center axis.

10. The yoke assembly of claim 1, wherein the loading means is disposed adjacently to at least one loading shoe.

11. The yoke assembly of claim 1, wherein the first and second roll bearing blocks are at least partially situated above one another.

12. A yoke assembly for connecting and securing an upper roll and a lower roll together, the upper and lower rolls forming a nip in an extended-nip press, whereby at least one of the rolls of the extended-nip press includes loading means for loading an endless-loop blanket of one of the rolls against the other of the rolls of the extended-nip press so as to establish the nip, wherein the lower roll and the upper roll are dismountably connected to each other and the yoke assembly connecting the upper and lower rolls of the extended-nip press to each other includes rotatable connecting members by means of which the extended-nip press rolls are detachably connected to each other by a pair of bearing blocks, wherein each of the connecting members comprises a first clamping surface adapted to be slidably rotatable on a respective mating surface of a first roll bearing block so that each of said first clamping surfaces and said respective mating surface of said first roll bearing block to be connected therewith form a pivotal joint about which the respective connecting member is adapted to be rotatably disengaged and engaged from a respective mating surface of a second roll bearing block, wherein the connecting members are adapted to connect the bearing blocks of roll heads of the upper and lower rolls to each other and the connecting members are linked to each other and are connected to one of the bearing blocks at an end portion of the first clamping surface via a link plate, whereby the connecting members thus linked to each other are pivotally rotatable about the pivot points by a pressurized-medium-driven actuator adapted to cooperate therewith, and wherein each of said first clamping surfaces and said respective mating surface of said first roll bearing block maintain direct connection at the pivotal joint when the connecting members are slidably rotated.

13. The yoke assembly of claim 12, wherein each of the connecting members comprises a body part formed by a first end portion having said first clamping surface, a second end portion having a second clamping surface thereon and a middle portion situated between the first and the second end portion.

14. The yoke assembly of claim 13, wherein the first clamping surface has an essentially cylindrically curved contour.

15. The yoke assembly of claim 13, wherein the second clamping surface has an essentially curved contour.

16. The yoke assembly of claim 12, wherein each of the mating surfaces of the first roll bearing block has an essentially concave contour.

17. The yoke assembly of claim 12, wherein each of the mating surfaces of the second roll bearing block has an essentially convex contour.

* * * * *